US005291766A

United States Patent [19]

Eisermann

[11] Patent Number: 5,291,766

[45] Date of Patent: Mar. 8, 1994

[54] LOCK WITH LOCKING FUNCTION RELEASED BY INSERTING A KEY CARD WITH A MAGNETIZED REGION

[75] Inventor: Armin Eisermann, Velbert, Fed. Rep. of Germany

[73] Assignee: Schulte-Schlagbaum Aktiengesellschaft, Velbert, Fed. Rep. of Germany

[21] Appl. No.: 916,138

[22] PCT Filed: Jan. 11, 1991

[86] PCT No.: PCT/EP91/00034

§ 371 Date: Jul. 22, 1992

§ 102(e) Date: Jul. 22, 1992

[87] PCT Pub. No.: WO91/11581

PCT Pub. Date: Aug. 8, 1991

[30] Foreign Application Priority Data

Jan. 25, 1990 [DE] Fed. Rep. of Germany ..... 4002092

[51] Int. Cl.[5] ..... E05B 47/00

[52] U.S. Cl. ..... 70/276; 70/361; 70/387; 70/389

[58] Field of Search ..... 70/276, 361, 387, 389, 70/390, 413

[56] References Cited

U.S. PATENT DOCUMENTS

| | | | |
|---|---|---|---|
| 1,163,470 | 12/1915 | Schoell | 70/409 |
| 3,418,833 | 12/1968 | Kerr | 70/389 |
| 3,995,460 | 12/1976 | Sedley | 70/389 X |
| 4,253,320 | 3/1981 | Schwab et al. | 70/276 |
| 4,576,025 | 3/1986 | Kassza et al. | 70/413 X |
| 4,676,083 | 6/1987 | Sedley et al. | 70/276 |
| 4,918,957 | 4/1990 | Eisermann | 70/276 |

FOREIGN PATENT DOCUMENTS

| | | | |
|---|---|---|---|
| 2249228 | 5/1975 | France | 70/413 |
| WO91/11582 | 8/1991 | PCT Int'l Appl. | 70/276 |
| 639171 | 6/1950 | United Kingdom | 70/389 |
| 1334086 | 10/1973 | United Kingdom | 70/276 |

*Primary Examiner*—Lloyd A. Gall
*Attorney, Agent, or Firm*—Martin A. Farber

[57] ABSTRACT

A lock with locking function released by inserting a key card with a magnetized region, in which the end edge (8') of the key card (8) drives a slide (25) which is released by the magnetic tumbler pins (31). There is at least one member which is displaceable by the movement of the slide, one end of the member scanning a profile of the key card (8). The member comprises a pin (62) which is tapered on both ends, the pin being displaceable parallel to the tumbler pins (31) in a borehole (61) in the slide (25) within a region which is free of the magnetic tumbler pins (31).

7 Claims, 8 Drawing Sheets

LOCK WITH LOCKING FUNCTION RELEASED BY INSERTING A KEY CARD WITH A MAGNETIZED REGION

FIELD AND BACKGROUND OF THE INVENTION

The present invention relates to a lock with locking function released by inserting a key card with a magnetized region, in which the front edge of the key card entrains a slide which is released by the magnetic tumbler pins.

The known locks of this type are developed in the manner that they possess a slide having a magnetic tumbler pin. For the accommodation of the tumbler pins, mounting recesses are provided in the slide and the tumbler pins cooperate with a suitably polarized key card. By the insertion of the proper key card, the magnetic tumbler pins leave a blocking plate so that a displacement of the slide can be effected by means of the key card.

SUMMARY OF THE INVENTION

The object of the invention is so to develop a lock of the above type in a manner simple to manufacture that a certain variation in profile with respect to the key card can be obtained in addition to increased security.

As a result of the invention, a lock of the above-mentioned type is created which, in addition to increased security, has the advantage of a variation in the profile of the key card. The key card to be introduced into the lock need not only be adapted in its opening code to the lock, but it must also have the proper profile. If the profile is absent, the key card can, it is true, be inserted, but it cannot move the slide. The supplementary tumbler which scans the profile of the key card stands, in this connection, as blocking element in the way within the region left free by the magnetic tumbler pins. The profile of the key card and the supplementary tumbler must accordingly be adapted to each other. Variations are possible in the development of the profile of both the supplementary element and the arrangement in the region left free by the magnetic tumbler pins. The development in accordance with the invention makes it possible to produce master key cards at little additional expense. The proven principle of magnetic tumblers which cooperate with the key card need not be discarded. One advantageous further development resides in forming the supplementary tumbler of a springless pin which can be moved by the movement of the slide into a hole in the key card. The suitably shaped key card can accordingly be inserted completely into the insertion shaft for the key card. Upon the subsequent movement of the slide, the pin, however, is moved into the hole in the key card. Therefore, the key card represents the space into which the pin can move. When a key card which has no hole is used, the evasion space is absent and accordingly no movement of the slide can take place. Control advantages in connection with the displacement of the pin result from the fact that the pin is tapered conically at both ends and that the tip facing the insertion shaft for the key card passes through a blocking plate. After insertion of the key and with the commencement of the forward movement of the slide produced by the key card the pin is moved away via its one frustoconical end while its other frustoconical end extends into the hole in the key card. If the blocking plate extends over the pin, it must form the necessary free space for the pin to pass through the blocking plate. In all cases the free space must be sufficiently large in order that the forward displacement of the pin is not prevented by the blocking plate. If the diameter of the magnetic tumbler pins is selected for the pin, then practically any mounting recess for the magnetic tumblers can be equipped with the supplementary pin. This is, to be sure, to be taken into consideration upon the shaping of the blocking plate.

BRIEF DESCRIPTION OF THE DRAWINGS

One embodiment of the invention will be described below with reference to the accompanying drawings, in which.

DETAILED DESCRIPTION OF THE PREFERRED EMBODIMENT

Figure 1:
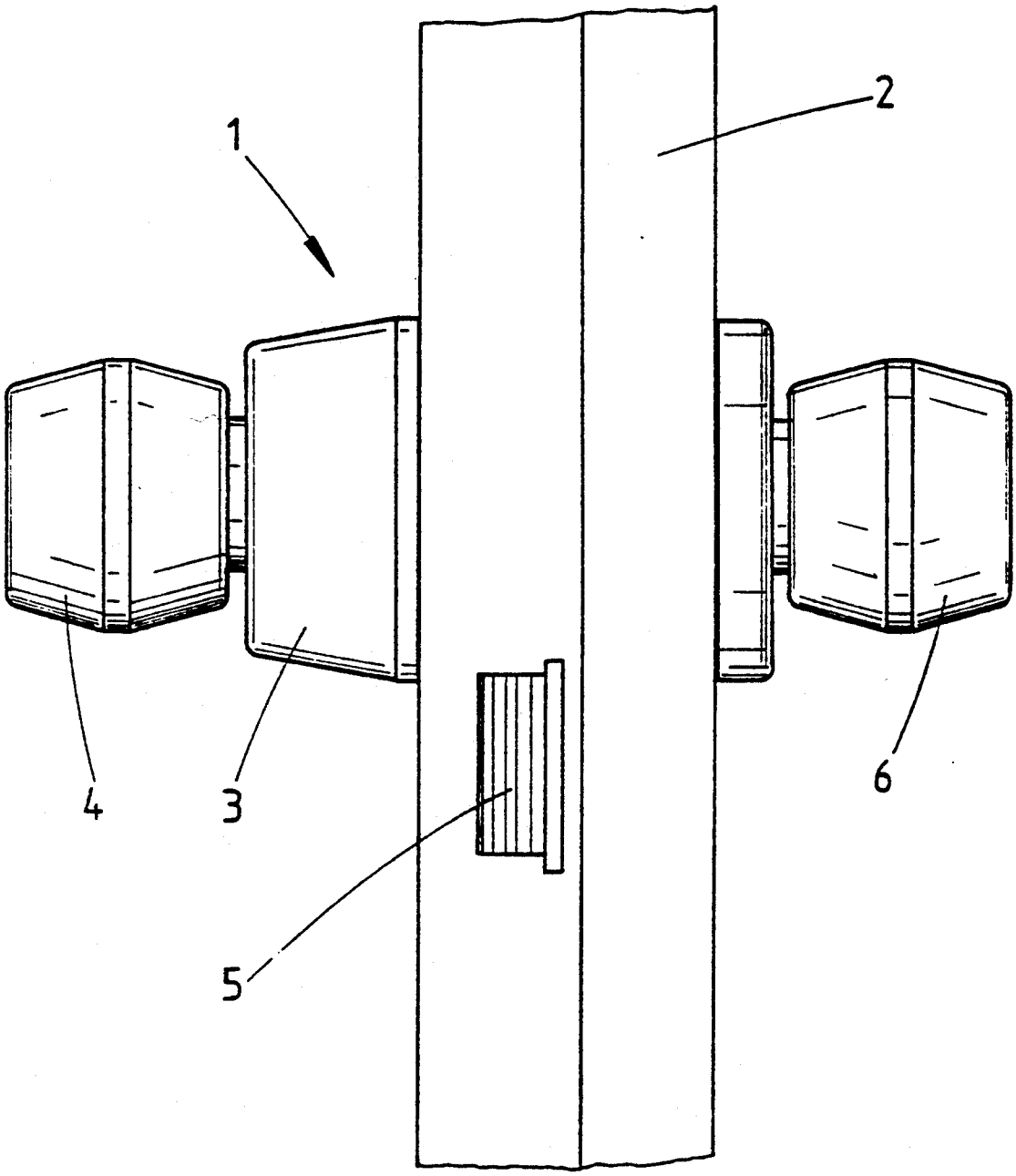
FIG. 1 shows a door provided with a lock developed in accordance with the invention, seen in the direction looking at the edge of the door.
Figure 2:
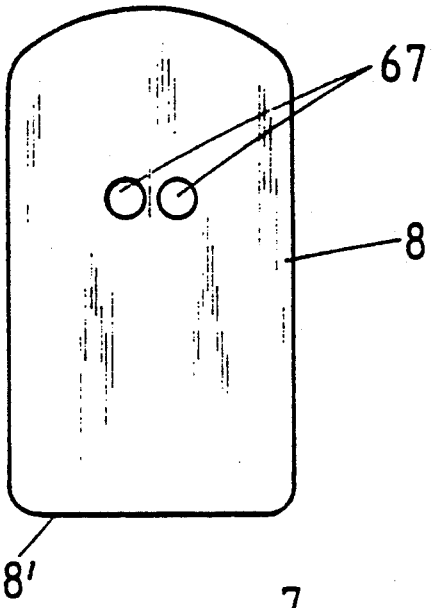
FIG. 2 shows a correspondingly developed key card by itself.
Figure 4:
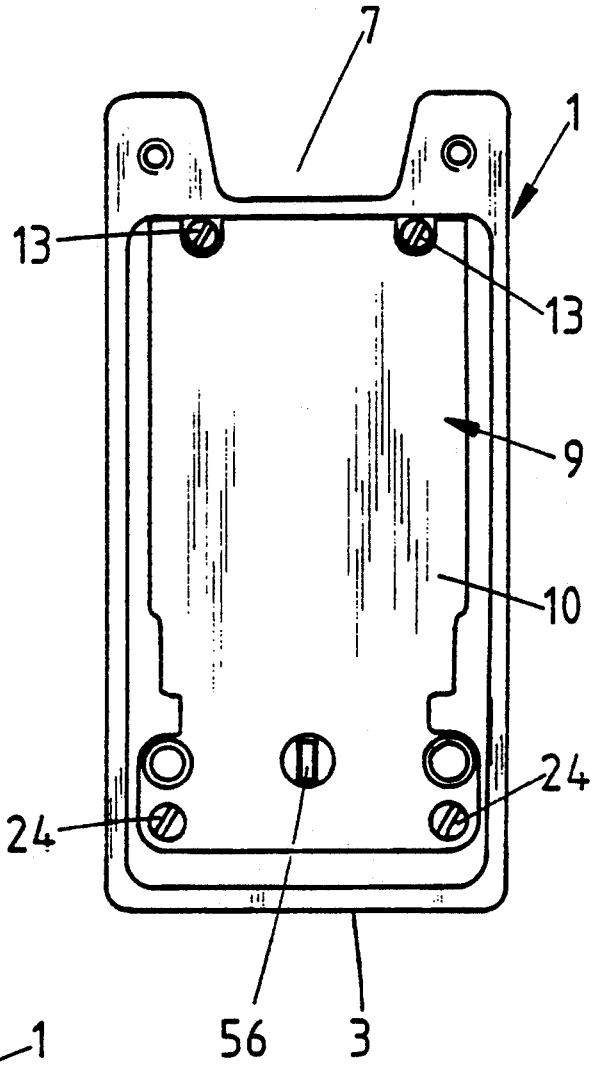
FIG. 4 is a rear view of the lock.
Figure 3:
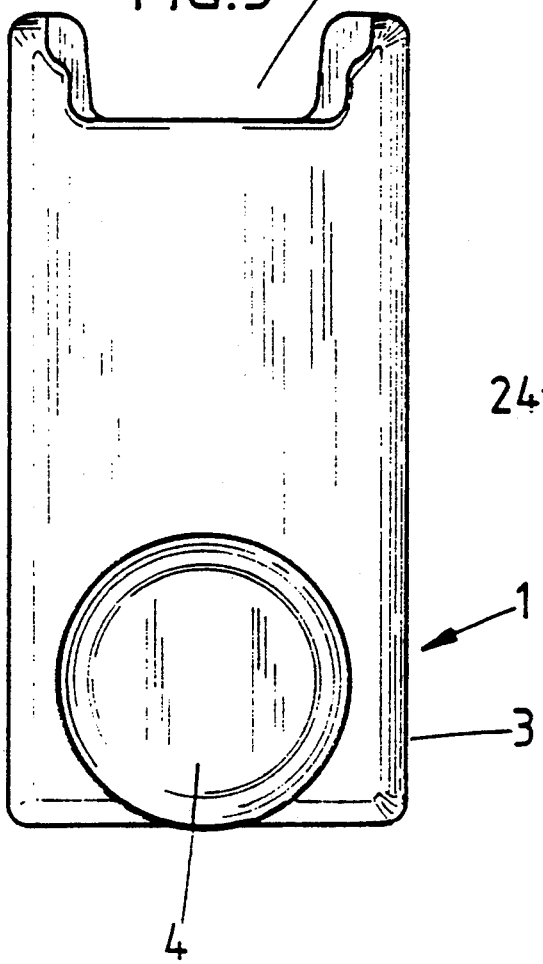
FIG. 3 is a top view of the lock.
Figure 5:
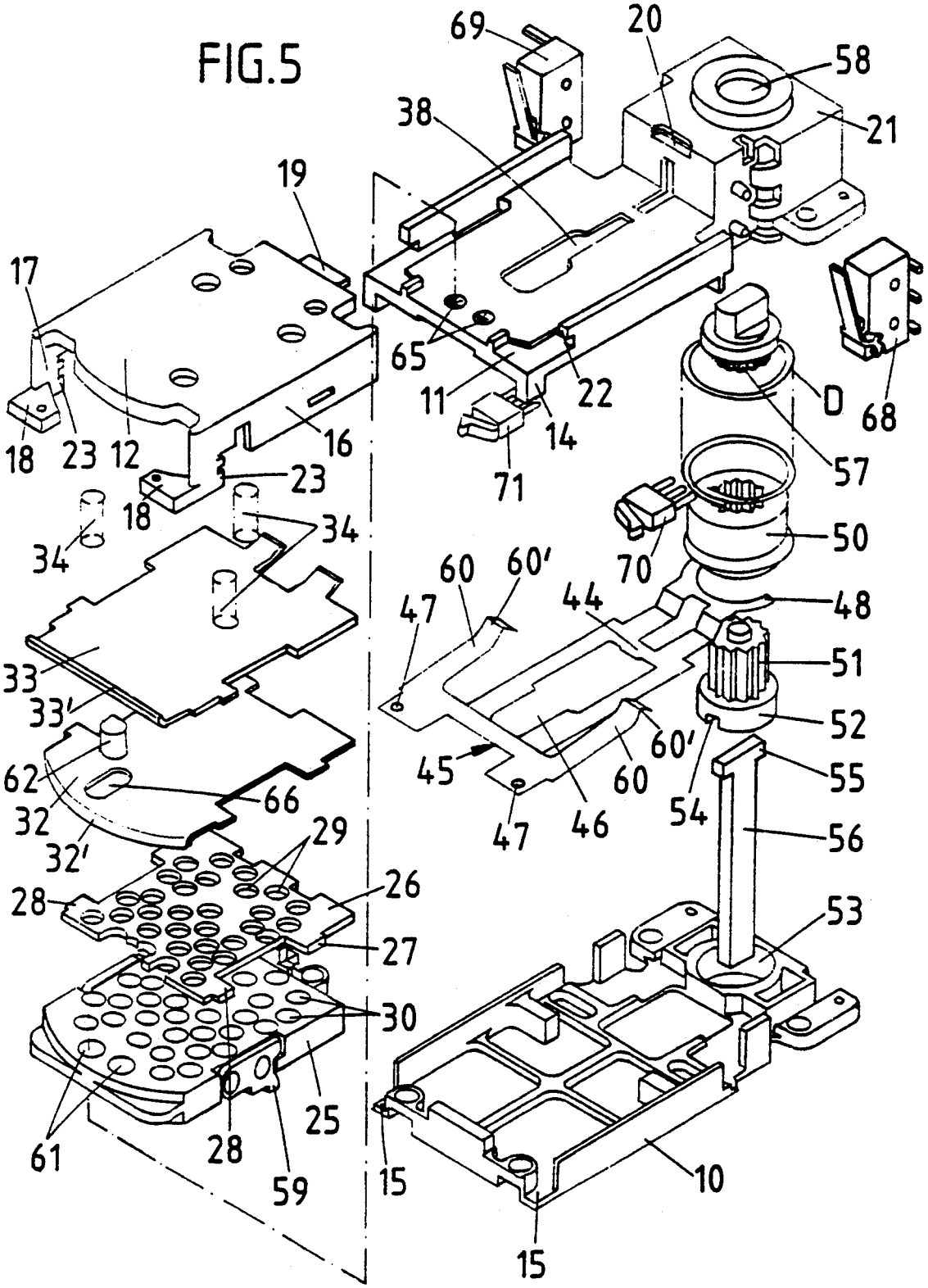
FIG. 5 is an exploded view in perspective of the essential parts of the lock.
Figure 7:
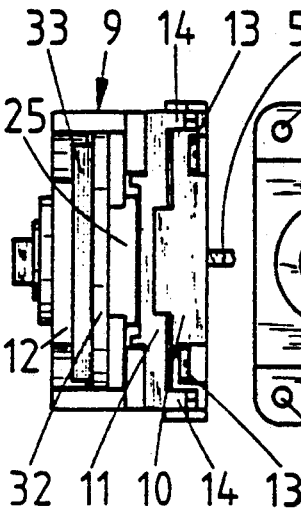
FIG. 7 is a side view of FIG. 6.
Figure 6:
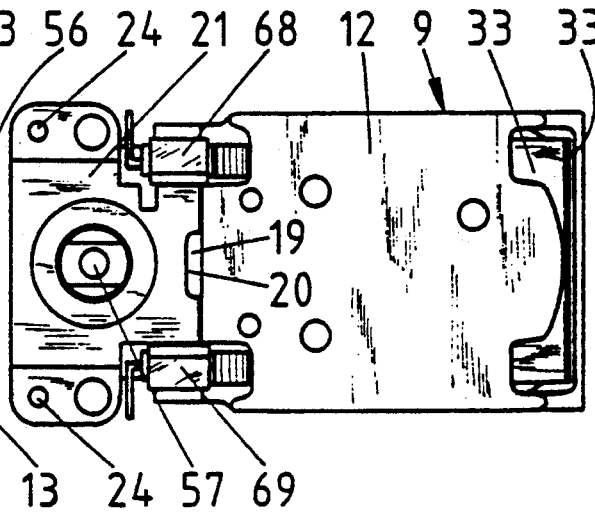
FIG. 6 is a top view of the inner lock housing.
Figure 8:
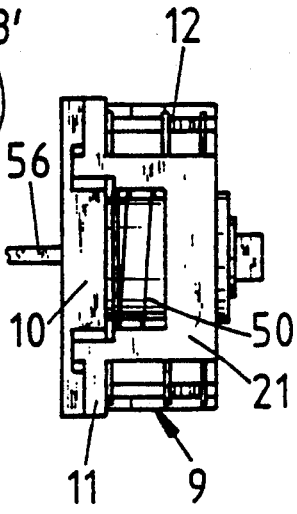
FIG. 8 is a side view of FIG. 6.
Figure 9:
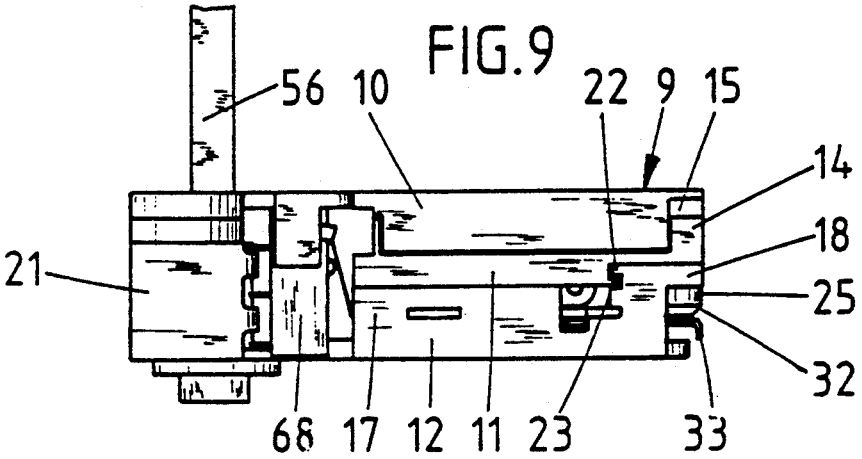
FIG. 9 is a side view of the lock housing.
Figure 10:
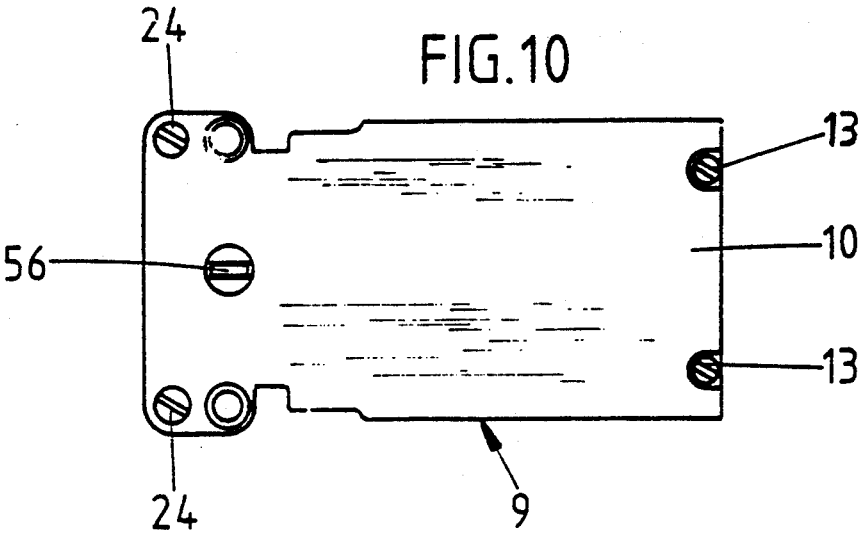
FIG. 10 is a rear view of the lock housing.

Referring to FIG. 1, a lock 1 developed in accordance with the invention is attached to a door 2, for instance the door to a hotel room. The lock 1 has a lock case of rectangular contour which is arranged on the outside of the door and bears an actuating handle 4 on its one end. By means of this knob, the latch 5 can be moved back. An inside knob 6 arranged on the inside of the door 2 is, on the other hand, connected directly to the latch 5 so that the door 2 can always be opened from that side of the door.

On its end opposite the actuating handle 4 the lock case 3 is provided with an insertion slot 7 for a key card 8 a region of which is magnetized. The lock case 3 furthermore receives a lock housing 9. The latter has a bottom part 10, a middle part 11 and a cover part 12. The bottom part 10, which is developed in the manner of a half shell, is attached to the middle part 11 by screws 13 which penetrate into said part. These two parts 10 and 11 are first of all pushed together, centering feet 14 which protrude from the middle part 11 and are directed towards the bottom part 10 engage into niches 15 in the bottom part 10 which are provided for this purpose. The screws 13 serve at the same time to attach the cover part 12. From the cover part there extend housing side walls 16, 17 which extend in the direction of the insertion of the card and are provided on the card-insertion end with inward-directed support lugs 18 into which the screws 13 engage. The end of the cover part 12 which is opposite the insertion slot 7 has a tongue 19 which, upon the pushing of the cover part onto the middle part 11, engages into a recess 20 in a dome 21 of the middle part 11. Furthermore, a rear gripping is obtained on the end of the side walls 16, 17 opposite the tongue 19 for which purpose hook-shaped projections 22 and 23 on the middle part 11 and cover part 12 engage with one another.

Figure 11:
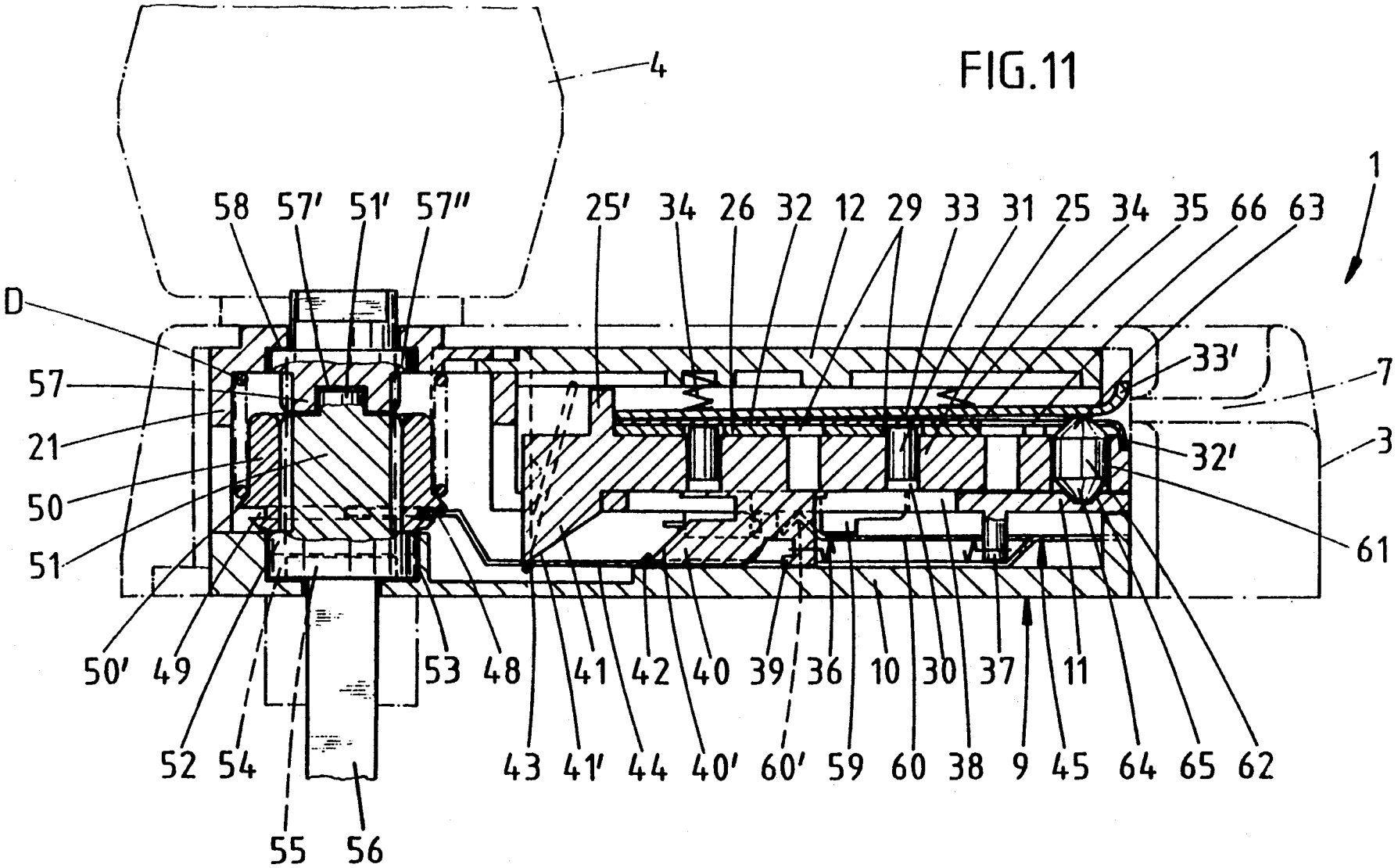
FIG. 11 is a longitudinal section through the lock with the slide in the end position of rearward displacement.
Figure 12:
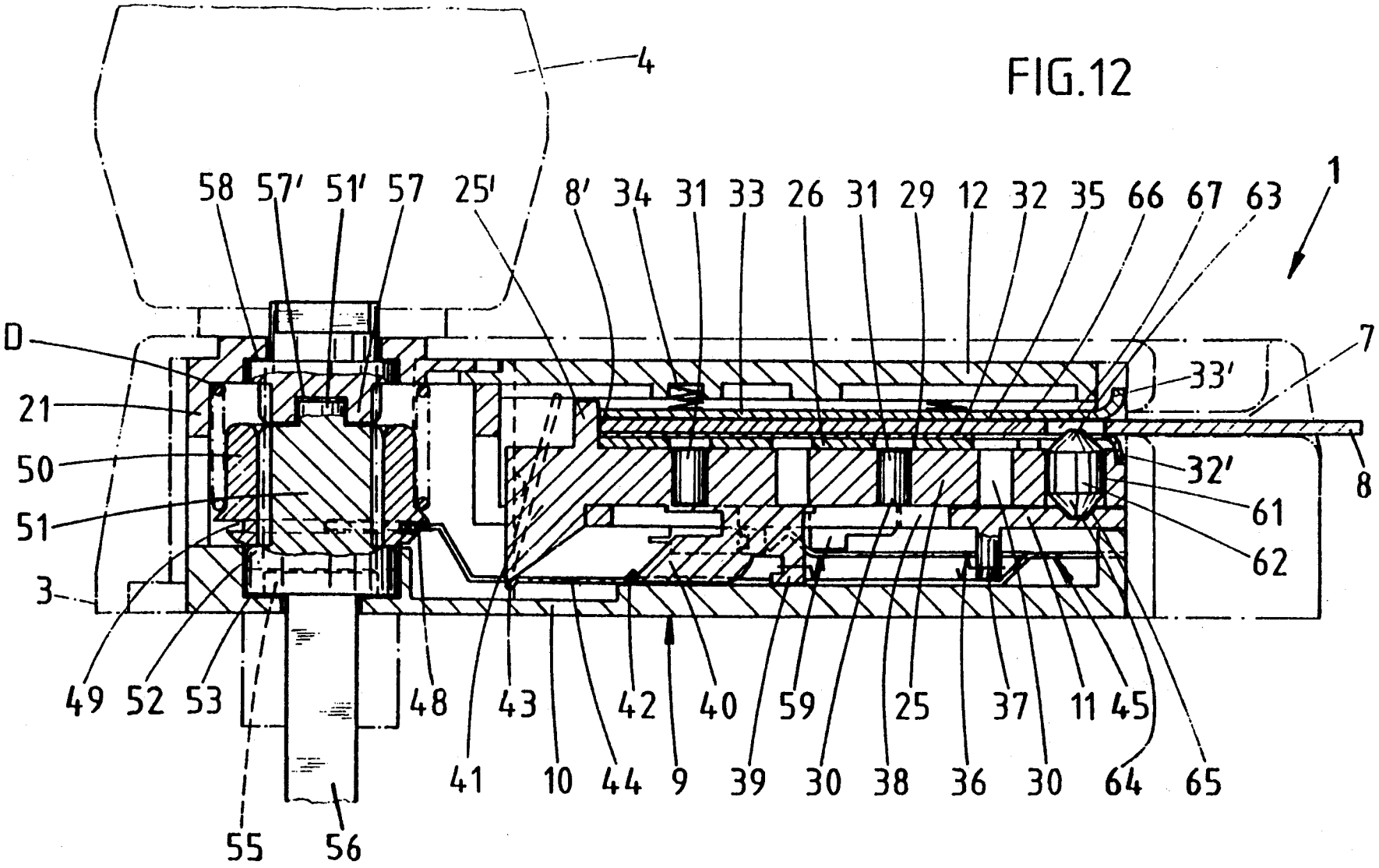
FIG. 12 is a view corresponding to FIG. 11, the key card being inserted completely into the insertion shaft.

The bottom part 10 as well as the middle part 11 are furthermore combined into a unit by two further screws 24 on the end facing away from the insertion slot 7. While aluminum is used for the bottom part 10 and middle part 11, the cover part 12 consists of plastic. Between the cover part 12 and the middle part 11 a plate-shaped slide 25 also made of plastic is guided. The one broad side of the slide 25 rests on the middle part 11. The opposite guide surface is formed by a blocking plate 26 made of brass which is inserted into the cover part and held immovable there by laterally protruding sections 27, 28. In the interlock position of the lock shown in FIG. 11 the holes 29 of the blocking plate 26 are aligned with bearing recesses 30 of the slide 25 which are developed as continuous holes. Magnetic tumbler pins 31 lie in the bearing recesses 30. It is not necessary to provide a tumbler pin 31 in each bearing recess 30 since the number, position and polarity of the tumbler pins 31 depends on the specific opening code/-combination of the lock 1.

On the other side of the blocking plate 26 there is a guide plate 32, also of brass, opposite which there is an armature plate 33. The latter is held in position by three compression springs 34. Said compression springs 34 in their turn rest against the cover part 12.

The armature plate 33, in contradistinction to the other parts, consists of ferromagnetic material. Thus, the armature plate 33 attracts the magnetic tumbler pins 31 which accordingly engage into the holes 29 in the blocking plate 26. In this position, the slide 25 cannot be pushed out of its basic position shown in FIG. 11 since the engagement of the tumbler pins 31 in the blocking plate 26 which is fastened to the housing prevents this. It would be possible to provide some of the bearing recesses 30 of the slide 25 in rotatable bodies (not shown) of the slide in order to be able to effect a change in code by turning said rotatable bodies.

Both the armature plate 33 and the guide plate 32 adjoin the insertion slot 7 of the lock case 3. Their front transverse edges 32', 33' are bent in opposite direction and form a wedge for the insertion card 8 which is to be inserted. In this connection the broad surfaces of guide plate 32 and armature plate 33 which face each other represent the card-insertion shaft (passage) 35.

A draw spring 36 which serves as return spring has its one end fastened on a transverse pin 37 of the middle part 11. This transverse pin 37 protrudes from the side of the middle part 11 opposite the slide 25 and extends into the inside of the bottom part 10. The other end of the draw spring 36 is engaged on a projection 39 of the slide 25 which passes through a slot 38 in the middle part 11, whereby the slide is moved into a stop-limited basic position in FIG. 11. In front of the projection 39 there are furthermore two beveled noses 40, 41 of the slide 25 which, in the same way as the projection 39, pass through the middle part 11. The bevels 40', 41' of the noses 40, 41 are developed in the same direction. They engage on obliquely bent up lugs 42, 43 of an arm 44 of a tongue 45 of spring material. A central cutout 46 in the spring is passed through in this connection by the nose 40.

The insertion-side end of the spring tongue 45 extends between the middle part 11 and the bottom part 10 and is fixed there by means of the screws 13, which pass through passage openings 47 in the spring tongue 45.

The end plate 48 which is opposite the attachment end of the spring tongue 45 is developed in fork shape and engages into an annular groove 49 of an internally toothed coupling sleeve 50. In accordance with the uncoupled position shown in FIG. 11, the coupling sleeve 50 surrounds a pinion 51 a collar 52 of larger cross section of which is arranged in a bearing opening 53 in the bottom part 10. Within the collar 53 there is a diametral slot 54 into which an end 55, shaped as a hammer head, of a latch spindle 56 extends. The latter is attached, fixed for rotation, to the inner knob 6.

A gear 57 is opposite the pinion 51. Both the pinion 51 and the gear 57 have identically shaped toothing and are adapted to the inner toothing of the coupling sleeve 50. The gear 57, on its part, is firmly attached to the outer door knob 4. In order to stabilize the position of the gears 51, 57, a centering pin 51' is provided which extends from the pinion 51 and passes into a blind hole 57' of suitable cross section in the gear 57. The centering pin extends within the dome 21 of the middle part 11 and lies there via a collar 57" of larger cross section in a bearing cavity 58 in the dome 21. In the uncoupled position the coupling sleeve 50 surrounds solely the pinion 51 and accordingly is not in engagement with the gear 57. Turning the outer door knob 4 therefore does not result in the driving of the gear 51 and thus of the latch spindle 56. In order that the coupling sleeve 50 does not unintentionally leave its basic position, a compression spring D is provided which surrounds the coupling sleeve 50 and rests at one end against the inside of the dome 21 and at the other end acts on a collar 50' of the coupling sleeve 50.

On each of its narrow edges in the direction of displacement the slide is provided with a stop projection 59. These projections cooperate with lateral spring sections 60 of the tongue 45, which spring sections cooperate with the stop projections 59 via detent noses 60'.

A form-locked coupling can be produced between the key card 8 and slide 25. The form-locked coupling is formed by a pin 62 mounted in a bored hole 61 in the slide 25. The bored hole 61 is located on the mouth-side end of the key-card insertion shaft. In accordance with the embodiment shown, two such bored holes 61 are arranged symmetrical to the longitudinal center of the slide 25. However, only one bored hole 61 is provided with a pin 62. The two ends 63, 64 of the pin 62 are conical. The total length of the pin 62 is greater than the thickness of the slide 25. The conical end 64 facing the central part 11 engages, within the end position of rearward displacement of the slide 25 into a frustoconical recess 65 in the lock housing or of the central part 11. The depth of this recess 65 is less than the height of the conical end 64. In this end position of rearward displacement, the other conical end 63 protrudes over the other broad surface of the slide 25 and extends into the keycard insertion shaft 35 in such a manner that the conical end 63, passing through a slot 66 in the guide plate 32, rests against the armature plate 33.

Figure 14:
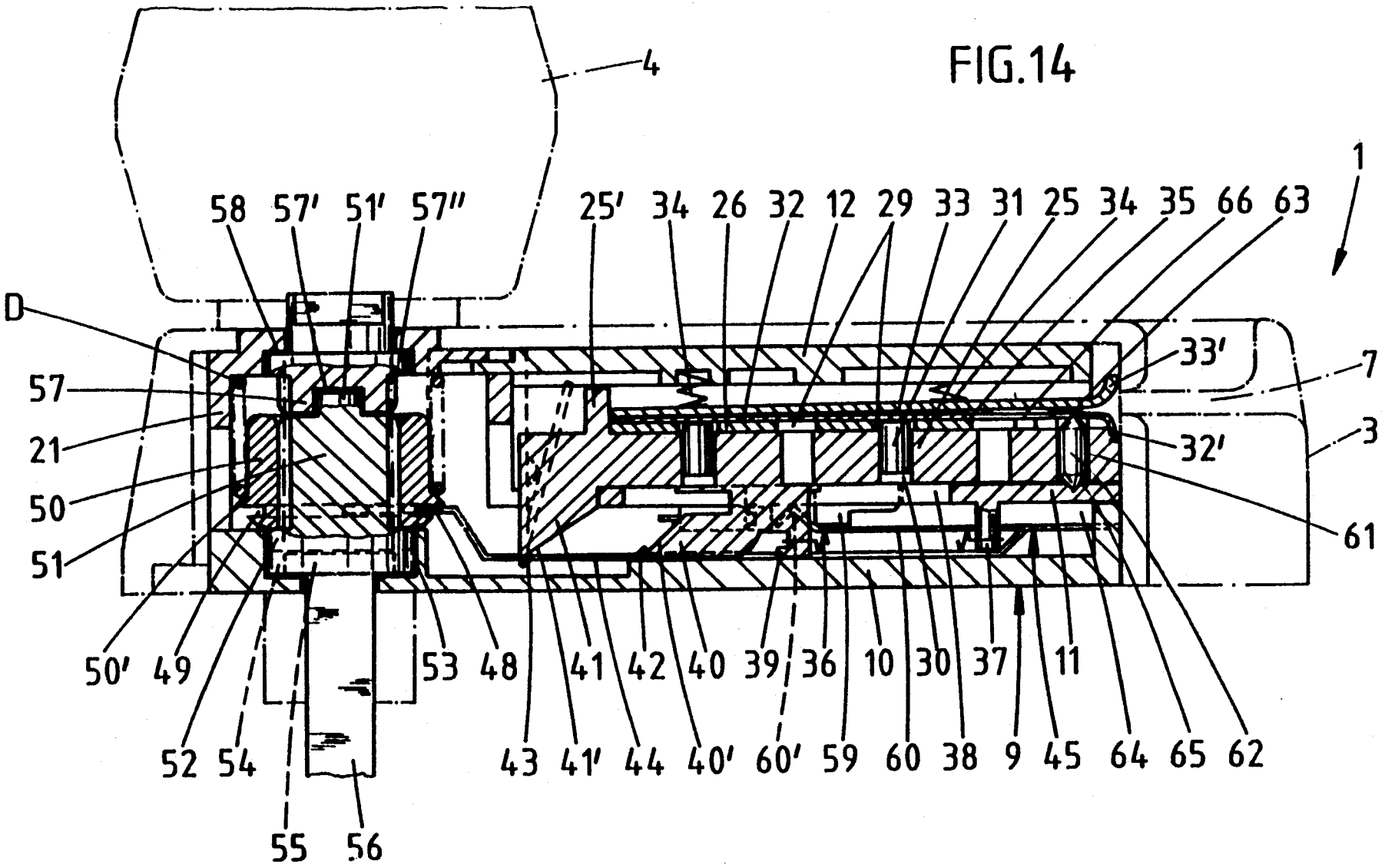
FIG. 14 is a view corresponding to FIG. 11 showing the pin having the same diameter as the magnetic tumbler pins.

The pin 62 cooperates with one of two holes 67 in the key card 8. These holes 67 are also arranged symmetrical to the longitudinal center of the key card 8. When two bored holes 61 and two holes 67 are provided, the guide plate 32 is also to be provided with two slots 66 so that after the insertion of the pin 62 it extends through one or the other slot. The lock can, however, also be developed in such a manner that the key card 8 has only one hole and the slide 25 has only one bored hole 61. This applies also with respect to the slot 66 in the guide plate 32. It would be possible to arrange the pin 62 at some other point of the slide 25. One conceivable variation would be for the pin 62 to have the same diameter as the tumbler pins 31 (cf. FIG. 14) so that it could also be arranged in one of the corresponding bearing recesses 30 in the slide 25.

Figure 13:
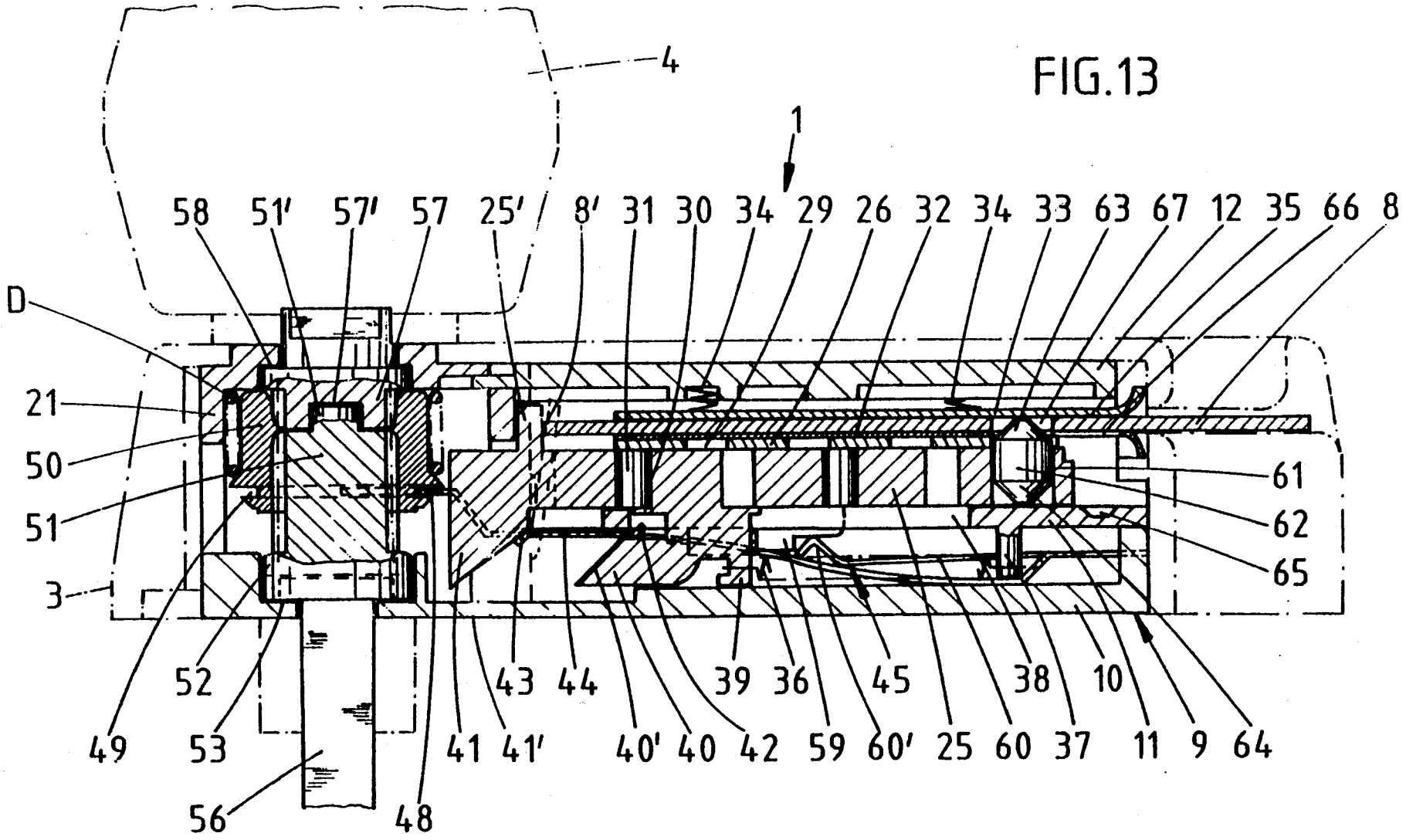
FIG. 13 shows the following position after FIG. 12 with the slide moved forward by means of the key card producing the form-locked coupling between key card and slide and the coupling of the actuating handle to the latch bolt.

The manner of operation is as follows: If the lock 1 is to be actuated from the outside by means of the outer door knob 4, it is necessary to introduce the correctly coded key card into the insertion slot 7. It thereby displaces in transverse direction the armature plate 33 which is acted on by the compression springs 34. In the completely inserted position the front edge 8' of the key card 8 on the insertion side comes in front of a slide stop 25' facing in the direction of the cover part 12. In this position the magnetic tumbler pins 31 are so displaced that they leave the holes 29 in the blocking plate 26. Furthermore, the end 63 of the pin 62 facing the key card insertion shaft is aligned with one of the two holes 67 in the key card. The key card 8 can now be moved further, the slide 25 being carried along against the force of the draw spring 36. During this displacement, the recess 65, in combination with the conical end 64, effects a control of the pin 62 in such a manner that, as can be noted from FIG. 13, the latter extends into the corresponding hole 67 in the key card 8. A key card which forms no hole could, to be sure, be inserted but no forward displacement of the slide would be possible since the space for the evasion of the pin 62 is not present.

In the forward displaced position, the detent noses 60' of the spring section 60 engages behind the stop projections 59 of the slide 25 and hold the latter in the forward displaced position. Together with the forward displacement of the slide 25, the arm 44 was also acted on by the bevel 40' of the nose 40 and the spring tongue 45 swung around its clamping point. Since the free forked end 48 of the tongue 45 is in engagement with the coupling sleeve 50, the latter is displaced in such a manner that it then extends also over the gear 57. Since now both gears 51, 57 are covered by the coupling sleeve 50, the lock 1 can be actuated by means of the outside knob 4. It is not possible to withdraw the key card in the coupling position in such a manner that the lock remains in the coupling position. Upon the removal of the key card 8, the slide 25 is positively moved into the end position of rearward displacement via the pin 62 which has entered into the key card. The slide in this connection comes into alignment with the recess 65 and thus permits the complete withdrawal of the key card. During the card removal movement the detent between the stop projections 59 and the detent noses 60' of the spring tongue 45 has also been overcome so that the starting position is again present. The coupling sleeve 50 has also been moved back in the manner that beveled surface 41' of the other nose 41 acts on the lug 43 of the arm 44 and thus also returns the spring tongue 45 into its end position.

Furthermore, electric switches 68, 69, 70, 71 are provided on the lock housing 9, which, in their turn, are actuated by the slide 25. The controlling of the electric switches is, however, not essential to the invention so that this will not be described further.

I claim:

1. A lock having a locking function adapted to be released by insertion of a key card which is magnetized in a plurality of regions thereof, a housing, a slide translatable within the housing for releasing a latch of the lock, and a plurality of magnetic tumbler pins disposed in mounting recesses located in a region of the slide; wherein an edge of the key card drives said slide upon release of said slide by said magnetic tumbler pins, the mounting recesses in said slide extend transverse to the direction of insertion of the key card;

the lock further comprises at least one element which is displaceable in a direction perpendicular to a path of motion of the key card upon movement of said slide, one end of said element scanning a profile of a part of the key card; and said element comprises a pin which is tapered on both ends, said pin being displaceable in a borehole in the slide within a further region of the slide which is free of said magnetic tumbler pins, said element providing additional security in operation of the lock.

2. A lock according to claim 1, wherein said element is displaceable in a direction parallel to said magnetic tumbler pins.

3. A lock according to claim 1, wherein the slide has stop means, and the key card has an opening positioned for receiving said element upon insertion of the key card to a position of abutment with said stop means;

wherein prior to reception of said element in said card opening, said element is operative to block movement of said slide to prevent release of the lock.

4. A lock according to claim 3, wherein said element is a supplementary tumbler springless pin which is urged into said card opening upon abutment of the key card with said stop means.

5. A lock according to claim 4, further comprising a blocking plate, and wherein said supplementary tumbler pin is tapered conically at both of its ends, and the taper facing the path of motion of the key card passes through said blocking plate.

6. A lock according to claim 3, wherein said housing includes a frame member having a depression for receiving an end of said element prior to reception of said element in said card opening.

7. A lock according to claim 1, wherein said pin has the same diameter as said magnetic tumbler pins.

* * * * *